United States Patent [19]

Wu et al.

[11] Patent Number: 4,927,195

[45] Date of Patent: May 22, 1990

[54] DUAL BACKSET DEADBOLT ASSEMBLY

[75] Inventors: Rong-Faa Wu; Shoei-Jyi Wu, both of Chiayi Hsien, Taiwan

[73] Assignee: Posse Lock Manufacturing Co., Ltd., Chiayi, Taiwan

[21] Appl. No.: 268,435

[22] Filed: Nov. 8, 1988

[51] Int. Cl.[5] ..... E05C 1/16

[52] U.S. Cl. ..... 292/169.14; 292/337; 292/DIG. 74

[58] Field of Search ..... 292/169.18, 169.21, 292/169.22, 169.23, 169.14, 337, 171, 172, DIG. 60, 1, 358, 336.5

[56] References Cited

U.S. PATENT DOCUMENTS

| | | | |
|---|---|---|---|
| 2,253,257 | 8/1941 | Wellman | 292/172 |
| 2,990,209 | 6/1961 | Butler | 292/169.22 |
| 3,927,905 | 12/1975 | Erickson | 292/169.22 |
| 4,427,224 | 1/1984 | Bergen | 292/169.23 |
| 4,615,549 | 10/1986 | Couture | 292/1 X |
| 4,623,174 | 11/1986 | Trull et al. | 292/169 X |
| 4,687,239 | 8/1987 | Lin | 292/DIG. 69 X |
| 4,711,477 | 12/1987 | Fann et al. | 292/169.14 |
| 4,750,766 | 6/1988 | Shen | 292/337 |
| 4,804,216 | 2/1989 | Maroito | 292/169 X |

*Primary Examiner*—Eric K. Nicholson

*Attorney, Agent, or Firm*—Fleit, Jacobson, Cohn, Price, Holman & Stern

[57] ABSTRACT

A dual backset deadbolt assembly to be associated with a lock having a rotatable cylinder which has two axially extending crank members for actuating a deadbolt to move in two opposite directions, wherein the deadbolt assembly comprises a deadbolt housing holding a deadbolt, a rear extension housing having two side plates with aligned crank holes therein, a transmission plate having a front end engaging with the deadbolt, and two independently movable axial strip members slideably provided between two side plates on either side of the crank holes provided in the side plates, the strip members being connected to the rear forked portion of the transmission plate and having a plurality of teeth each extending into each crank hole, the strip members being selectable for cooperation with the operative crank member by the engagement of one of the teeth and the operative crank member.

8 Claims, 5 Drawing Sheets

DUAL BACKSET DEADBOLT ASSEMBLY

BACKGROUND OF THE INVENTION

The invention relates to a deadbolt assembly having two selectable backset distances which permit a cylinder lock to be mounted on a door at one of two different distances from the edge of the door, and particularly to a dual backset deadbolt assembly which includes a deadbolt operating mechanism to cooperate with a cylinder lock having two deadbolt operating crank members capable of actuating a deadbolt to move in either one of two opposite directions, wherein the mechanism has two independently movable transmission units which can be selected to cooperate with one of the deadbolt operating crank members of the cylinder lock.

Deadbolt assemblies having two selectable backset distances are known in the art. U.S. Pat. No. 4,711,477, issued on an application of one of the present inventors, discloses a dual backset deadbolt assembly to cooperate with a cylinder lock which has a single rearwardly extending elongated crank member with an arched cross section for operating the deadbolt assembly. The deadbolt assembly comprises two side plates which are provided with two crank holes at two selectable backset distances for positioning the crank member. In this deadbolt assembly, the single crank member of the cylinder lock can actuate the deadbolt to move in a single direction. Generally, doors can be installed in two different manners, one manner being where the door can be opened by being moved towards the right and the other manner being where the door can be opened by being moved towards the left. For the door of the former case, the deadbolt should be able to retract to the right and be attached to the left side of the door. For the door of the latter case, the deadbolt must retract to the left and be attached to the right side of the door. A disadvantage of the single deadbolt operating crank member and the deadbolt assembly disclosed in the above mentioned patent is that the prior art crank member and deadbolt assembly cannot be used for both left opening and right opening door designs, as mentioned above and is applicable only for a door that can be opened in one direction either left or right.

SUMMARY OF THE PRESENT INVENTION

An object of the present invention is to provide a dual backset deadbolt assembly which can be operated in combination with a lock having two rearwardly extending crank members so that the deadbolt can be actuated in one of two opposite directions, forward and backward, and the deadbolt assembly can be mounted in doors of both the left opening and right opening designs.

According to the present invention, a dual backset deadbolt assembly is used in association with a cylinder lock having a rotatable cylinder with two axially extending crank members for actuating the deadbolt assembly in two opposite directions, wherein the deadbolt assembly comprises: a deadbolt housing; a deadbolt mounted in the deadbolt housing; an extension housing having two parallel side plates which have front ends connected to the deadbolt housing, each of the side plates having a plurality of crank holes respectively aligned with the crank holes of the other side plate to form through-holes adapted to receive the crank members so that the crank members can be turned about a horizontal axis at a plurality of selectable backset distances; a transmission plate means slideably provided between the side plates, the transmission plate means having a front engaging member, extending into the deadbolt housing and engaging with the deadbolt, and a rear forked portion; and two independently movable axial strip members slideably provided between the side plates above and below the through-holes, each of the strip members being connected to the rear forked portion and having a plurality of teeth, each extending into each of the through-holes, the teeth being capable of engaging with the operative one of the crank members, the strip members being selectable for cooperation with the operative crank member by the engagement of one of the teeth and the operative crank member.

The crank members of the cylinder lock have a concave cross-section substantially similar to a segment of an annulus, the crank members being symmetrical and respect to an axis of rotation of the rotatable cylinder.

In one aspect of the invention, the strip members include two linear strip members one of which is above the through-holes and the other of which is below the through-holes, each strip member having a front engaging member to engage with the hook member of each prong and two spaced apart teeth extending respectively into the through-holes.

In another aspect of the invention, the strip members include two strip members each of which is U-shaped and each of which has two limbs extending respectively at the upper and lower side of the crank holes, each strip member having two teeth which extend respectively in opposite directions from the limbs of each strip member and which are staggered with one another so as to extend into the crank holes respectively, the two strip membes being abutting with one another and each having an engaging member which can be engaged with the transmission plate means.

In still another aspect of the invention, the transmission plate means is formed integrally with the strip members, the transmission plate means including two transmission plates which are abutted with one another, each transmission plate having two prongs which are elongated to form the strip members, each transmission plate having two teeth which extend respectively in opposite directions from the two prongs of each transmission plate and which are staggered with one another so as to extend respectively into the crank holes.

The present exemplary preferred embodiment will be described in detail with reference to the accompanying drawings, in which:

DETAILED DESCRIPTION OF THE PREFERRED EMBODIMENT

Figure 1:
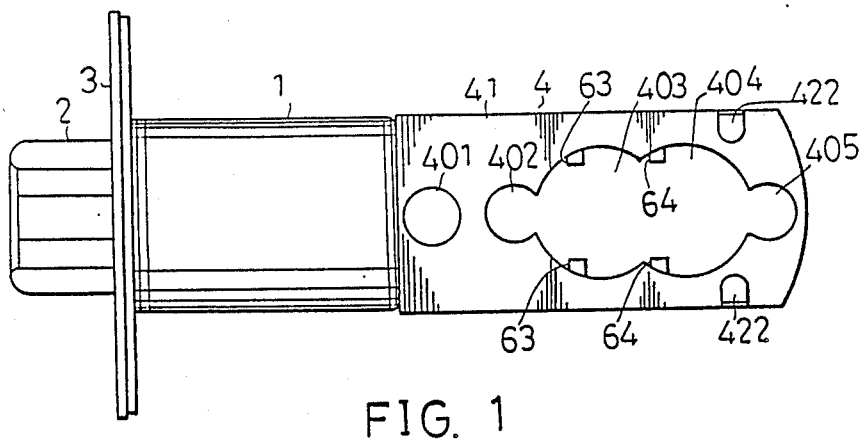
FIG. 1 is a left side view of the deadbolt assembly of the present invention.
Figure 2:
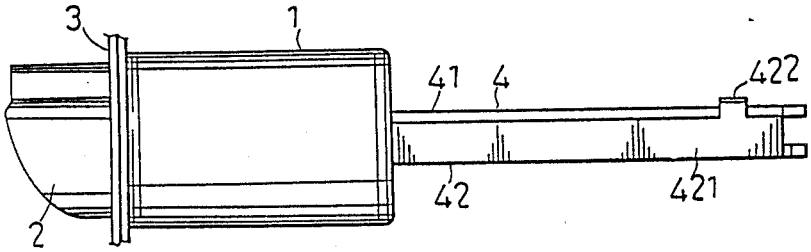
FIG. 2 is a top plan view of the deadbolt assembly of FIG. 1.
Figure 3:
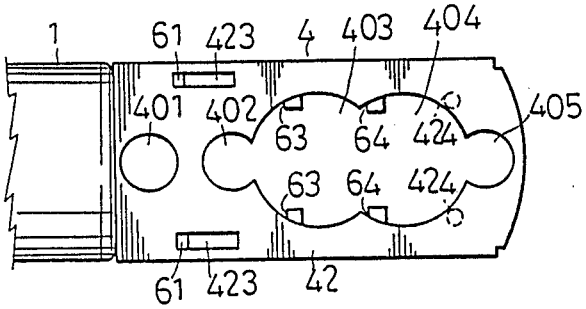
FIG. 3 is a right side view of the deadbolt assembly of FIG. 1.

Referring to FIGS. 1, 2 and 3, a preferred embodiment of the deadbolt assembly according to the present invention is shown, including a deadbolt housing 1 holding a deadbolt 2 and a mounting plate 3 by which the deadbolt housing can be mounted on a door. Since the construction of the deadbolt 2 does not form any part of the present invention, the details thereof are not provided herein. The deadbolt assembly further has an extension housing which is constituted of two side plates 41 and 42. The side plate 42 is provided with upper and lower bent portions 421 which extend towards and engage with the side plate 41 with tongues 422. Both the side plates 41 and 42 are provided with securing holes 401, 402 and 405 and tow intersecting crank holes 403 and 404. Two positioning pins 424 extend inwardly from the inner side of the side plate 42.

Figure 4:
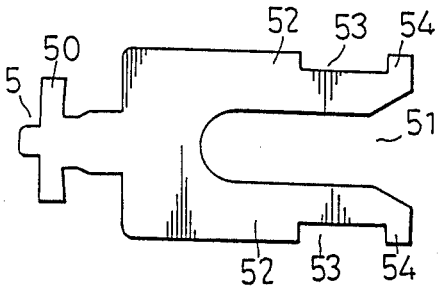
FIG. 4 is a side view of a transmission plate of the deadbolt assembly.
Figure 5:
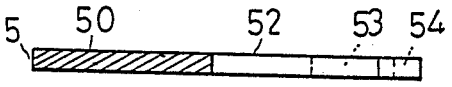
FIG. 5 is a top plan view of the transmission plate of FIG. 4.

As shown in FIGS. 4 and 5, a transmission plate 5 is provided between the side plates 41 and 42. The transmission plate 5 has a front engaging end 50 extending into the deadbolt housing. The rear portion of the plate 5 is forked so that an elongated opening 51 is formed between prongs 52. Each prong 52 is provided with a recess 53 and an engaging end 54.

Figure 6:
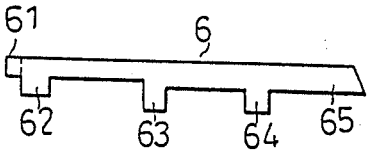
FIg. 6 is a side view of a strip member.
Figure 7:
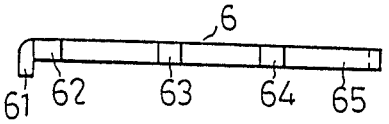
FIG. 7 is a top plan view of the strip member.
Figure 9:
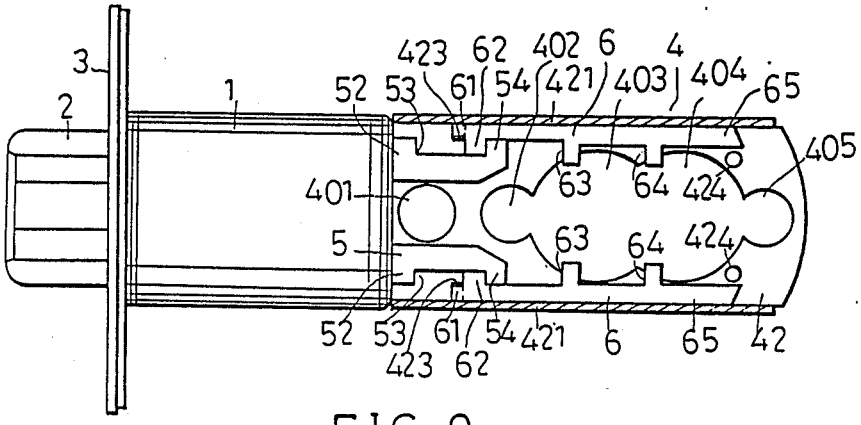
FIG. 9 is a sectional view of the deadbolt assembly of FIG. 1.

As shown in FIGS. 6, 7, and 9, two parallel independent strips 6 are placed between the side plates 41 and 42, one being above the crank holes 403 and 404 and the other being below the crank holes 403 and 404. Each strip 6 is provided with a hook member 61 to extend into each slot 423 of the side plate 42, a tooth 62 to engage with the engaging end 54 of the transmission plate 5, two crank engaging teeth 63 and 64, and a positioning tail 65 which is adapted to be held slideably between one of the bent portions 421 of the side plate 42 and one of the positioning pins 424.

In assembly, as shown in FIG. 9 the transmission plate 5 is placed between the side plates 41 and 42. The front portion of the transmission plate 5 extends into the housing 1 and is connected to the deadbolt 2. The hook member 61 of each strip 6 is inserted into each guide slot 423 of the side plate 42. The tooth 62 of the front end of each strip 6 is engaged with the engaging end 54 of the transmission plate 5. The rear end 65 of each strip 6 is slideably held between one of the bent portions 421 of the side plate 42 and one of pins 424. The teeth 63 and 64 extend into the the crank holes 403 and 404, respectively.

Figure 8:
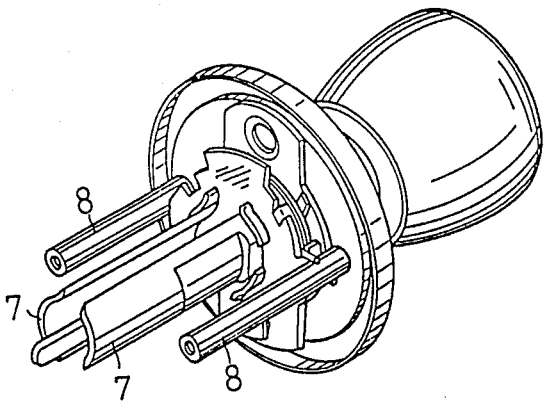
FIG. 8 is a perspective view of a cylinder lock to be associated with the deadbolt assembly of the present invention.

FIG. 8 shows a cylinder lock to be used in association with the latch assembly of the present invention. The cylinder lock is known in the art but is modified to have two axially extending, deadbolt operating crank members 7 which have a concave cross-section substantially similar to a segment of an annulus and whose concave sides oppose one another. The two crank members 7 are symmetrical with respect to an axis of rotation of the cylinder lock. The crank holes 403 and 404 of the side plates 41 and 42 permit the crank member 7 to be located at two selectable backset distances, for instance, two standard distances of 60 mm and 70 mm. For the purpose of securing the lock to the deadbolt assembly, bolts 8 can be inserted into the securing holes 401 and 405, respectively, when the crank members 7 are placed in the front crank hole 403, i.e. at a 60 mm backset distance, or one of the bolts 8 can be inserted into the securing hole 402 and the other bolt 8 left free when the crank members 7 are held in the rear crank hole 404, i.e. at a 70 mm backset distance.

Figure 10:
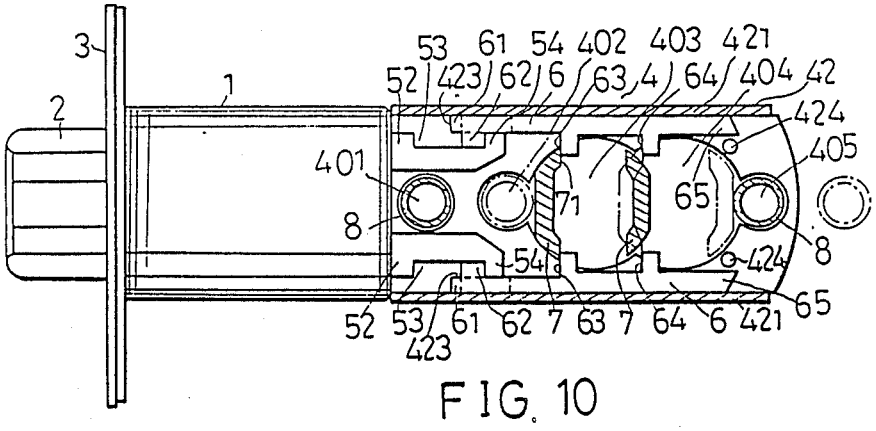
FIGS. 10 and 11 show the operation of the deadbolt assembly of FIG. 1.
Figure 11:
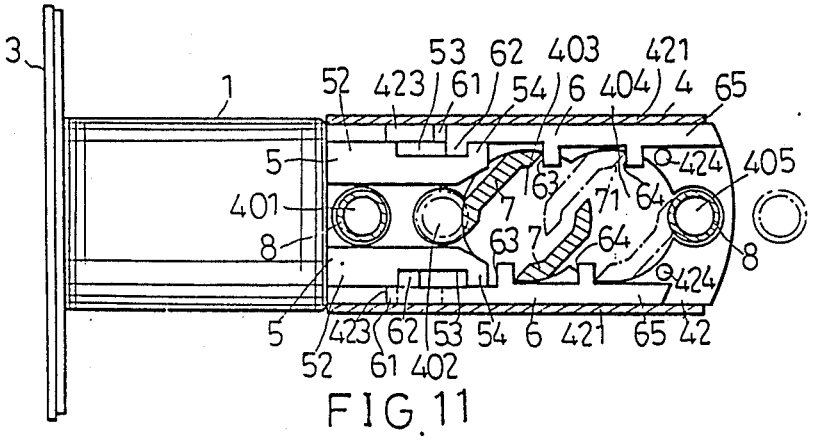

The operation of the lock and the deadbolt assembly is shown in FIGS. 10 and 11. When the crank members 7 are inserted in the front crank hole 403, the upper edge 71 of one of the crank members 7 engages with the tooth 63. When the cylinder lock is turned clockwise, the upper edge 71 moves the upper strip 6 rearward, thereby placing the deadbolt 2 in an unlatching position. The lower strip 6 does not move in this operation. Similarly, when the crank members 7 are inserted into the crank hole 404, as shown in dotted lines, the upepr edge 71 can move the upper strip 6 rearward.

It is to be noted that only one crank member 7 and the upper strip 6 are operative, and the movement of the upper strip 6 is independent of the movement of the lower strip, in the above-mentioned operations. However, if the position of the deadbolt assembly is reversed, for example, from the left side of a door to the right side of the door, the other crank member 7 and the lower strip 6 will be in operation upon the clockwise rotation of the cylinder lock. It can also be appreciated that the counterclockwise operation of the cylinder lock may equivalently effect the operation of the deadbolt assembly.

Figure 12:
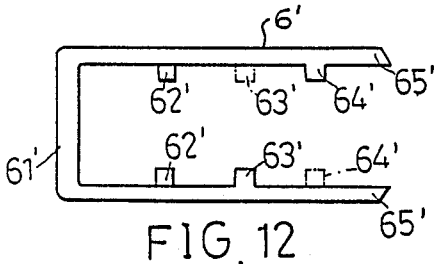
FIG. 12 shows another strip member according to the present invention.

FIG. 12 shows an alternative strip member 6' to be associated with the transmission plate 5. The strip members 6' are substantially U-shaped. When in use, two strip members 6' are abutted with one another and inserted between the side plates 41 and 42. The two strip member 6' can be selected to cooperate with the transmission plate 5 and one of the crank members 7. In assembly, the portions 61' of the strip members 6' are inserted into the deadbolt housing. Each strip member 6' has a tooth 62' which is aligned with the tooth 62' of the other strip member 6', a tooth 63' on one of the limbs thereof and a tooth 64' on the other limb thereof. The teeth 63' and 64' of each strip member 6' are staggered with one another but are aligned respectively with the teeth 63' and 64' of the other strip member 6'.

Figure 13:
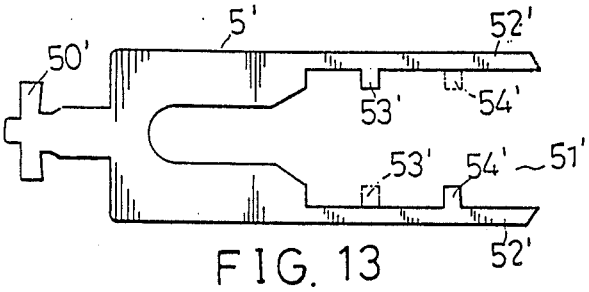
FIG. 13 shows still another strip member according to the present invention.
Figure 14:
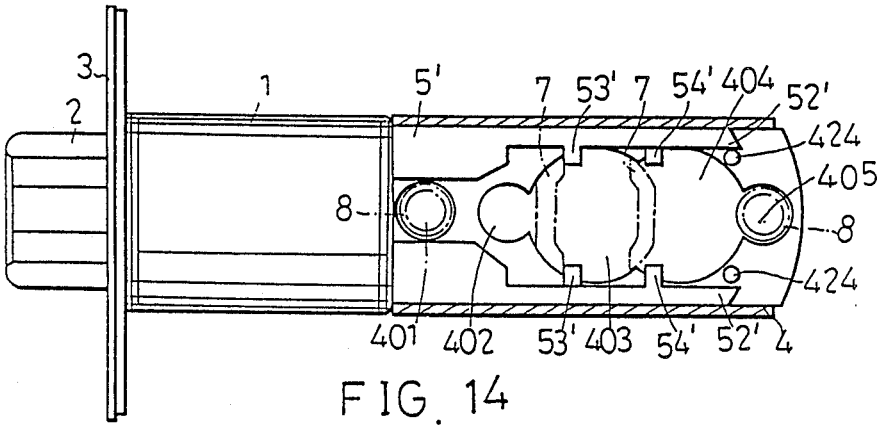
FIGS. 14 and 15 show the operation of the deadbolt assembly incorporating the strip member of FIG. 13.
Figure 15:
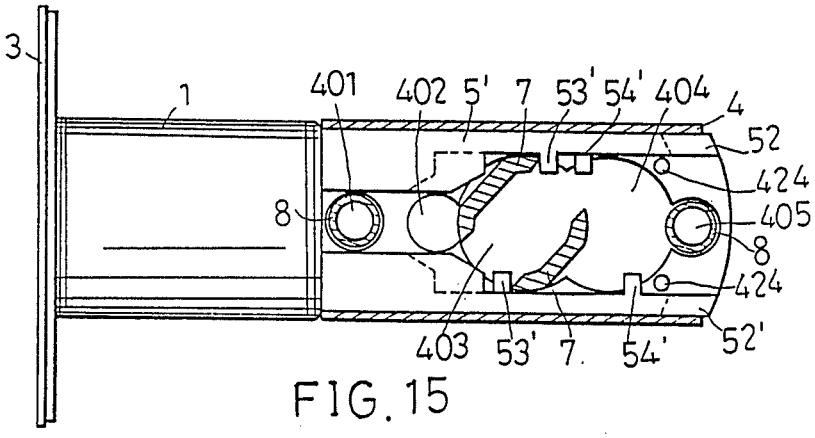

FIGS. 13, 14 and 15 show another embodiment of the deadbolt assembly of the present invention which has two selectable transmission plats 5' which are abutted with one another and inserted between the side plates 41 and 42. Each transmission plate 5' has an engaging end 50' and a rear forked portion which is formed integrally with two strip members 52'. One of the strip members 52' of each transmission plate 5' has a tooth 53', and the other strip member 52' thereof has a tooth 54' which is staggered with the tooth 53'.

The two transmission plates 5' are independently movable. When the crank members 7 are inserted into the crank hole 403 or 404, one of the crank members 7 actuates the tooth 53' or 54' of one of the transmission plates without interfering with the tooth 53' or 54' of the other transmission plate 5'.

With the invention thus explained, it is apparent that numerous modifications and variations can be made without departing from the scope of the invention. It is therefore intended that the invention be limited as indicated in the appended claims.

What I claim is:

1. A dual backseat deadbolt assembly to be used in association with a lock having a rotatable cylinder which has two axially extending crank members for actuating said deadbolt assembly to move in either one of two opposite directions, wherein said deadbolt assembly comprises:

a deadbolt housing;

a deadbolt mounted in said deadbolt housing for moving to a locking position or an unlocking position upon rotation of said lock;

an extension housing having two parallel side plates which have front ends connected to said deadbolt housing, each one of said side plates having a plurality of crank holes, said plurality of crank holes of one side plate being respectively aligned with said plurality of crank holes of the other side plate to form through-holes, each one of said through-holes establishing a different selectable backset distance of said deadbolt and being capable of receiving said crank members so that said crank members can be turned about a horizontal axis at one of said backset distances;

a transmission plate means slideably provided between said side plates, said transmission plate means having a front engaging member and a rear forked portion, said front engaging member extending into said deadbolt housing and engaging with said deadbolt;

two independently movable axial strip members slideably provided between said side plates, one of said axial strip members being above said through-holes and the other said axial strip member being below said through-holes, each one of said axial strip members being connected to said rear forked portion of said transmission plate means and having a plurality of teeth extending into said through-holes, each one of said plurality of teeth being capable of engaging with one of said crank members when said lock is rotated, wherein rotation of said lock causes one of said crank members to cooperatively engage a tooth on one of said axial strip members, said axial strip members being selectable for cooperation with one of said crank members depending on which direction said lock is rotated.

2. A dual backset deadbolt assembly as claimed in claim 1, wherein said side plates have two crank holes to form two through-holes.

3. A dual backset deadbolt assembly as claimed in claim 2, wherein said rear forked portion of said transmission plate means has two rearwardly extending prongs, each one of said prongs having a hook member to engage with each one of said axial strip members.

4. A dual backset deadbolt assembly as claimed in claim 3, wherein said axial strip members include two linear strip members, one linear strip member being positioned above said through-holes and the other linear strip member being positioned below said through-holes, each one of said linear strip members having a front engaging member to engage with said hook member of each of said prongs and having two spaced apart teeth extending respectively into said through-holes.

5. A dual backset deadbolt assembly as claimed in claim 3, wherein said axial strip members include two strip members each one of which has two limbs extending respectively above and below said through-holes, each one of said limbs having a tooth, said tooth on one of said limbs being staggered with respect to said tooth on the other one of said limbs so that said teeth extend into respective through-holes, said two strip members being abutted with one another and having engaging members extending into the housing.

6. A dual backset deadbolt assembly as claimed in claim 3, wherein said transmission plate means is formed integrally with said axial strip members, said transmission plate means including two transmission plates which are abutted with one another, said axial strip members being formed from said transmission plates having two of said prongs extending therefrom, each of said transmission plates having two teeth, said teeth on one of said transmission plates being staggered with respect to said teeth on the other one of said transmission plates and all of said teeth extending into respective through-holes.

7. A combination of a cylinder lock and a dual backset deadbolt assembly comprising:

a deadbolt housing;

a deadbolt mounted in said deadbolt housing for moving to a locking position or an unlocking position upon rotation of said lock;

a cylinder lock having a rotatable cylinder which has two axially extending crank members for actuating said deadbolt to move in either one of two opposite directions;

an extension housing having two parallel side plates which have front ends connected to said deadbolt housing, each one of said side plates having a plurality of crank holes, said plurality of crank holes of one side plate being respectively aligned with said plurality of crank holes of the other side plate to form through-holes, each one of said through-holes establishing a different selectable backset distance of said deadbolt and being capable of receiving said crank members so that said crank members can be turned about a horizontal axis at one of said backset distances;

a transmission plate means slideably provided between said side plates, said transmission plate means having a front engaging member and a rear forked portion, said front engaging member extending into said deadbolt housing and engaging with said deadbolt;

two independently movable axial strip members slideably provided between said side plates, one of said axial strip members being above said through-holes and the other said axial strip member being below said through-holes, each one of said axial strip members being connected to said rear forked portion of said transmission plate means and having a plurality of teeth extending into said through-holes, each one of said plurality of teeth being capable of engaging with one of said crank members when said cylinder lock is rotated, wherein rotation of said cylinder lock causes one of said crank members to cooperatively engage a tooth on one of said axial strip members, said axial strip members being selectable for cooperation with one of said crank members depending on which direction said lock is rotated.

8. A combination as claimed in claim 7, wherein said crank members of said cylinder lock having a concave cross-section substantially similar to a segment of an annulus, the configurations of said crank members being symmetrical with respect to an axis of rotation of said rotatable cylinder.

* * * * *